United States Patent [19]

Ong

[11] Patent Number: 4,581,791

[45] Date of Patent: Apr. 15, 1986

[54] BUCKLE

[76] Inventor: Swee L. M. Ong, c/o F. J. Benjamin & Sons PTE Ltd., 1101-1104 Tong Bldg., 302 Orchard Rd., Singapore, Singapore, 0923

[21] Appl. No.: 372,609

[22] Filed: Apr. 28, 1982

[30] Foreign Application Priority Data

Jun. 4, 1981 [GB] United Kingdom ..... 8117180

[51] Int. Cl.[4] ..... A44B 11/00

[52] U.S. Cl. ..... 24/163 K; 40/21 C

[58] Field of Search ..... 24/163 KO, 163 K; 40/21 C, 1.5, 1.6, 447, 620; 2/322, 321, 301; 224/103, 167, 170, 163, 173, 180, 164

[56] References Cited

U.S. PATENT DOCUMENTS

| | | | |
|---|---|---|---|
| 1,127,895 | 2/1915 | Kahn | 40/21 C |
| 1,139,415 | 5/1915 | Hathaway | 224/167 |
| 1,383,968 | 7/1921 | Perry et al. | 224/163 |
| 1,508,963 | 9/1924 | Dorf | 24/163 KO |
| 2,655,664 | 10/1953 | Ramos | 2/301 |
| 3,365,877 | 1/1968 | Altman | 224/170 |
| 3,372,500 | 3/1968 | Claude | 40/21 C |
| 3,605,302 | 9/1971 | Muller | 40/447 |
| 3,709,412 | 1/1973 | Broido | 224/170 |
| 3,855,637 | 12/1974 | Luger | 2/301 |
| 3,882,617 | 5/1975 | Gagner | 40/21 C |
| 4,260,087 | 4/1981 | Leaver | 24/163 K |

FOREIGN PATENT DOCUMENTS

| | | | |
|---|---|---|---|
| 352123 | 7/1931 | Fed. Rep. of Germany . | |
| 844555 | 7/1952 | Fed. Rep. of Germany | 40/21 C |
| 435565 | 5/1948 | Italy | 2/301 |
| 22845 | 6/1917 | United Kingdom | 224/167 |
| 318128 | 9/1929 | United Kingdom . | |
| 469715 | 2/1937 | United Kingdom . | |
| 614097 | 7/1947 | United Kingdom . | |
| 1062717 | 3/1967 | United Kingdom . | |

*Primary Examiner*—John J. Wilson

*Attorney, Agent, or Firm*—Ladas & Parry

[57] ABSTRACT

The invention relates to a buckle having a connecting part for connection to the free end of a belt, the connecting part having a face aperture in which is rotatable, about a longitudinal axis, a badge holder, on the opposite faces of which different badges, i.e. motifs or other indicia can be displayed. The connecting part is additionally rotatable relatively to an attachment part fixed to the other end of the belt.

10 Claims, 3 Drawing Figures

BUCKLE

FIELD OF THE INVENTION

The present invention relates to buckles for belts or other straps, and more particularly to ornamental buckles which carry a badge or motif.

Such buckles can be used for purely decorative or ornamental purposes, or, alternatively, for advertising or identity purposes, in the latter case the buckle having a badge or insignia, for example of a particular association, team, company etc. It may be desirable to change the ornament, or insignia (hereinafter referred to as "badge") selectively. For example, a company badge might also be personalized to the user to enable him or her to select between for example the company emblem or name and his own personal initials.

SUMMARY OF THE INVENTION

In accordance with the present invention a buckle has a badge-holder therein, the badge-holder having opposite display faces and being rotatable about an axis lying substantially in the plane of the buckle to enable either of the faces of the badge-holder to be displayed.

The axis around which the badge-holder may be rotatable can be substantially aligned with what is in use the longitudinal axis of the belt, or can be inclined to it or even perpendicular to that longitudinal axis.

Preferably, the buckle itself is of a rotatable type such as may be used on reversible belts. A rotatable buckle may, for example, comprise an attachment part for fixing to the belt and a connecting part for attaching to the other end of the belt in use, the connecting part being rotatable 180° between two operative positions so that the belt can be reversed to show either of its sides.

Preferably, the buckle is formed with a display opening in its face, the badge holder being located and rotatable within the opening.

BRIEF DESCRIPTION OF THE DRAWINGS

Buckles constructed in accordance with the present invention will now be described with reference to the accompanying drawings in which like numerals indicate like elements.

FIG. 4 is similar to FIG. 1 but illustrates an alternate embodiment of the invention in which the axis of the badge holder lies transverse to the belt in use.

DESCRIPTION OF THE PREFERRED EMBODIMENTS

Figure 1:
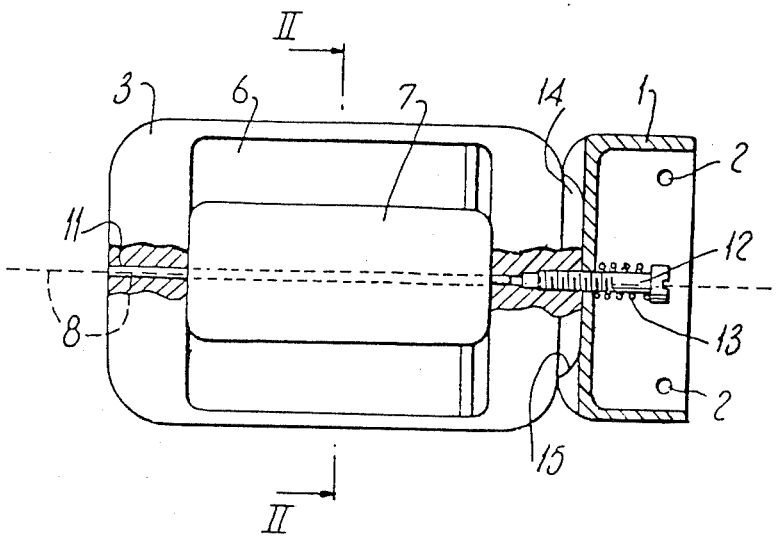
FIG. 1 is a front elevation, partly in section on the line I—I in FIG. 3.
Figure 2:
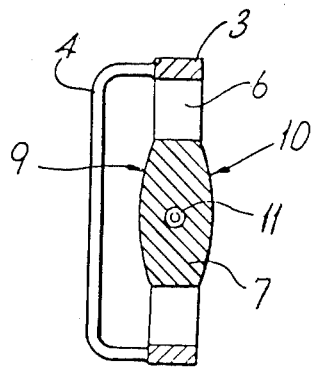
FIG. 2 is a vertical cross section on the line II—II in FIG. 1.
Figure 3:
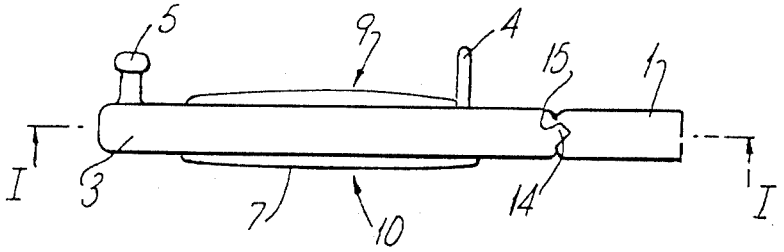
FIG. 3 is a top plan view of the buckle.

The buckle comprises an attachment part 1 for attaching to a belt by means of grub-screws through threaded apertures 2, the attachment part being hollow to receive the end of the belt to which it is permanently attached in use. Attached to the attachment part 1 is a connecting, buckle part 3 which has, on one face, a conventional bar 4 and pin 5. In use the free end of the belt is provided with apertures passing between the body of the connecting part 3 and the bar 4, the pin 5 engaging in one of the holes in the belt.

The connecting part 3 has a central aperture 6 across which is rotatably mounted a badge holder 7 about an axis 8 extending in line with the longitudinal axis of the belt in use, and centrally of the aperture. The badge holder 7 has opposite display faces 9 and 10 and is mounted on a hollow shaft 11 extending through the badge holder and into either end of the connecting part 3. Different badges, i.e. motifs etc. may be incorporated in the opposite faces 9 and 10 of the badge holder 7 as desired and as represented by the letter M in the drawings.

To enable the buckle to be used on reversible belts, that is to say belts which have two display sides, the connecting part 3 is rotatable about the central longitudinal axis 8 of the buckle between two positions 180° apart. This in effect enables the belt to be rotated relative to the connecting part 3 when it is desired to display a different side of the belt. To enable this rotation between the connecting part 3 and the attachment part 1 a screw-threaded bolt 12 extends through one side of the attachment part 1 into the adjacent side of the connecting part 3 and a helical coil spring 13 is interposed underneath the head of the bolt 12 to bias the two parts towards one another. In order to define the opposite relative positions of the connecting part and attachment part the connecting part is provided with an elongate rib 14 and the attachment part with a complementary groove 15 into which the rib locates in use.

Although the buckle may have plain faces on the connecting part, opposite sides of the connecting part can have different patterns or ornamentation, represented by the letter P so that the buckle can display four different combinations of badge and surrounding face if desired. It will be appreciated that the type of buckle to which the invention is applied is not limited to that shown in the drawings, but can be of any suitable type.

I claim:

1. A buckle comprising:

a first part having opposite display faces with indicia thereon and having a badge-holder in the first part, the badge-holder also having opposite display faces with indicia thereon and being rotatable with respect to the first part about a first axis lying substantially in the plane of the buckle to enable either of the faces of the badge-holder to be displayed;

a second part having means for attaching to a belt when the buckle is in use;

a second axis about which the first part rotates with respect to the second part to enable either of the faces of the first part to be displayed; and locating means for locating the first part of the buckle in either of two positions, spaced 180° apart in rotation, about the second axis.

2. A buckle comprising:

a badge-holder therein, the badge-holder having opposite display faces, the display faces having indicia thereon, the badge-holder being located in an opening in the buckle and being rotatable about an axis lying substantially in the plane of the buckle to enable either of the faces of the badge-holder to be displayed; and an axle mounted within the opening about which the badge-holder is rotatable, the buckle, the badge holder and the axle being configured so that the badge holder is continuously rotatable about the axle.

3. A buckle according to claim 2 or 1 wherein the axis of the badge holder is aligned with the longitudinal axis of a belt operatively associated with the buckle in use.

4. A buckle according to claim 2 or 1 wherein the axis of the badge-holder lies transverse to the longitudinal axis of a belt operatively associated with the buckle in use.

5. A buckle according to claim 1, wherein the buckle has an opening within which the badge-holder is located.

6. A buckle according to claim 1, further comprising a badge set into each of the faces of the badge-holder.

7. A buckle according to claim 2, including means for rotating part of the buckle relative to the belt to which it is to be attached in use.

8. A buckle according to claim 7, wherein the rotatable part of the buckle can be located in one of two positions spaced 180° apart about the axis of rotation of the rotatable part.

9. A buckle according to claim 7 or claim 8, wherein a connecting part of the buckle is rotatable about a longitudinal axis relative to a belt-attachment part of the buckle between two positions spaced 180° apart.

10. A buckle according to claim 1, in which the locating means comprises an elongate rib on one of the first and second parts and a groove complementary in shape to the rib on the other of said first and second parts.

* * * * *